United States Patent [19]

Shimosato et al.

[11] Patent Number: 5,011,308

[45] Date of Patent: Apr. 30, 1991

[54] RELEASING TYPE DOT PRINTER HEAD

[75] Inventors: Masashi Shimosato; Kuniaki Ochiai, both of Shizuoka, Japan

[73] Assignee: Tokyo Electric Co., Ltd., Tokyo, Japan

[21] Appl. No.: 349,832

[22] Filed: May 10, 1989

[30] Foreign Application Priority Data

May 10, 1988 [JP] Japan ..... 63-61484[U]
Jul. 5, 1988 [JP] Japan ..... 63-89359[U]

[51] Int. Cl.[5] ..... G41J 2/235
[52] U.S. Cl. ..... 400/124; 101/93.05
[58] Field of Search ..... 400/124; 107/93.05

[56] References Cited

U.S. PATENT DOCUMENTS

| | | | |
|---|---|---|---|
| 2,129,065 | 9/1938 | Loop | 400/124 |
| 4,167,343 | 9/1979 | Golobay | 400/124 |
| 4,278,020 | 7/1981 | Oaten | 400/124 |
| 4,403,875 | 9/1983 | Asano et al. | 101/93.05 |
| 4,437,775 | 3/1984 | Ochiai et al. | 400/124 |
| 4,472,071 | 9/1984 | Blomquist et al. | 400/124 |
| 4,501,506 | 2/1985 | Weeks et al. | 400/124 GT |
| 4,571,101 | 2/1986 | Sakaida | 400/719 X |
| 4,611,393 | 9/1986 | Norigoe | 29/602.1 |
| 4,618,277 | 10/1986 | Asano | 400/124 |
| 4,634,301 | 1/1987 | Sakaida et al. | 400/124 |
| 4,652,158 | 3/1987 | Asano | 400/124 |
| 4,674,179 | 6/1987 | Gugel | 29/602.1 |
| 4,767,226 | 8/1988 | Sakaida et al. | 101/93.05 |
| 4,913,570 | 4/1990 | Mitsuishi et al. | 400/124 |

FOREIGN PATENT DOCUMENTS

| | | | |
|---|---|---|---|
| 0041126 | 9/1981 | European Pat. Off. | 400/124 |
| 2512333 | 10/1976 | Fed. Rep. of Germany . | |
| 35736 | 3/1977 | Japan | 228/215 |
| 120257 | 9/1979 | Japan | 228/215 |
| 0201669 | 12/1982 | Japan | 400/124 |
| 0008665 | 1/1983 | Japan | 400/124 |
| 0104761 | 6/1983 | Japan | 400/124 |
| 0199266 | 11/1984 | Japan | 400/124 GT |
| 0178066 | 9/1985 | Japan | 400/124 GT |
| 61-44656 | 3/1986 | Japan . | |
| 61-121958 | 6/1986 | Japan . | |
| 0121958 | 6/1986 | Japan | 400/124 |
| 0122564 | 5/1988 | Japan | 400/124 GT |
| 570464 | 8/1977 | U.S.S.R. | 228/215 |
| 1478498 | 6/1977 | United Kingdom | 228/215 |

OTHER PUBLICATIONS

Patent Abstracts of Japan, vol. 12, No. 227 (M-713)[3074], 28th Jun. 1988; & JP-A-63 25 054 (Hitachi Ltd.) 02-02-1988 *Abstract*.

*Primary Examiner*—Edgar S. Burr
*Assistant Examiner*—John S. Hilten
*Attorney, Agent, or Firm*—Oblon, Spivak, McClelland, Maier & Neustadt

[57] ABSTRACT

Supporting parts are disposed on both sides of the end parts of a plurality of armatures to which needles are fixed. Elastic members are held by elastic-member-holding parts with limited play in the longitudinal direction of the armatures. The elastic members are inserted into wide holding parts allowing play in the longitudinal direction of the armatures, and needles are disposed in fixed positions. The elastic members are welded to elastic-member-holding parts and wide holding parts with the tip positions of needles used as standards.

8 Claims, 9 Drawing Sheets

RELEASING TYPE DOT PRINTER HEAD

FIELD OF THE INVENTION AND RELATED ART STATEMENT

The present invention relates to a dot printer head using needles, especially to a releasing type dot printer head in which the needle is released from magnetic restriction in the moment of printing and get impacting force energized by an elastic body.

The description on a supporting structure of an armature is found in Japanese Patent Applications of laid-open No. 44656/86 and laid-open No. 121958/86, on the conventional type of dot printer head, in which an armature facing a core having an electromagnetic coil being fitted in and supporting parts disposed on both sides of the armature are connected with a torsion bar which has elastic parts on both sides of the armature; the armature is rotated when the elastic parts are bent by exciting the electromagnetic coil, which moves a needle toward a platen side to perform a printing operation.

In the examples shown in FIG. 18 and FIG. 19, there are formed a through hole 53 to fit in the torsion bar 52 as an elastic member, and a solder holding hole 54 communicating with the intermediate part of the through hole 53 on an armature 50 and supporting parts 51 called torsion holders disposed on both sides of the armature 50. The torsion bar 52 is fitted into the through hole 53 and the torsion bar 52 is welded to the armature 50 and to the supporting parts 51 by melting the solder inserted into the solder holding hole 54.

The torsion bar 52 is fitted without play into the through hole 53 formed on the supporting parts 51 and the armature 50 to be welded to them. The armature 50 moves rotationally with the axis of the torsion bar as a supporting axis, but because of the dimensional dispersion of the supporting parts 51 or the through holes 53 the position of the rotating tip of the armature 50 or the position of the needle tip is dispersed. To put the needle tip positions in order, the needle tips are aligned by a needle guide made of an abrasion resistant material. The same means is also adopted in a printing head of a different armature supporting mechanism. To improve durability, it is necessary to decrease the friction between a needle guide and a needle. For this purpose, the length of a needle must be lengthened to make the bending stress of the needle small. If the needle length is lengthened, however, the weight is increased and the friction resistance between the needle and the guide is increased, which disturbs high speed printing. It pushes up the cost to keep the dimensional preciseness of the needle guide in high grade and to have to use an abrasion resistant material for the needle guide.

OBJECT AND SUMMARY OF THE INVENTION

A first object of the present invention is to obtain a dot printer in which tip positions of a plurality of needles are correctly aligned.

A second object of the present invention is to obtain a dot printer in which high speed printing is possible.

A third object of the present invention is to prevent needle breakage or ink ribbon breakage.

In the present invention: a plurality of cores in which electromagnetic coils are fitted and a plurality of armatures on which needles are fixed at the end parts are disposed opposingly; supporting parts are disposed on both sides of the other end parts of the armatures than those on which needles are fixed; a groove or a hole of such dimensions as the play in the longitudinal direction of the armature is limited for a torsion bar to be inserted into the groove or the hole is formed on the armature or the supporting parts; a wider groove or a wider hole in which the play is allowed in the longitudinal direction of the armature for the torsion bar to be inserted into the groove or the hole is formed on the armature or the supporting parts in the different way from the above; needles are disposed in regular positions and based on the tip positions of the needles, the torsion bars are welded to the grooves or the holes and to the wider grooves or the wider holes.

In this arrangement, when torsion bars are joined with armatures and supporting parts, owing to the play between the wider grooves or wider holes and torsion bars, armatures can be moved in the longitudinal direction; therefore aligning the tip positions of needles and then with these tip positions of needles as standards, the supporting parts, armatures and torsion bars are welded. In this way, needle tips are positioned accurately and needle guides are omitted, which makes it possible to cut down the cost. Moreover, the needles are not affected by stress of needle guides and the length of needles can be shortened; thus the needles cannot be easily bent, which helps the positioning of the needles to be more accurate; it also makes needles lighter to make high speed printing possible.

DETAILED DESCRIPTION OF PREFERRED EMBODIMENTS

Figure 1:
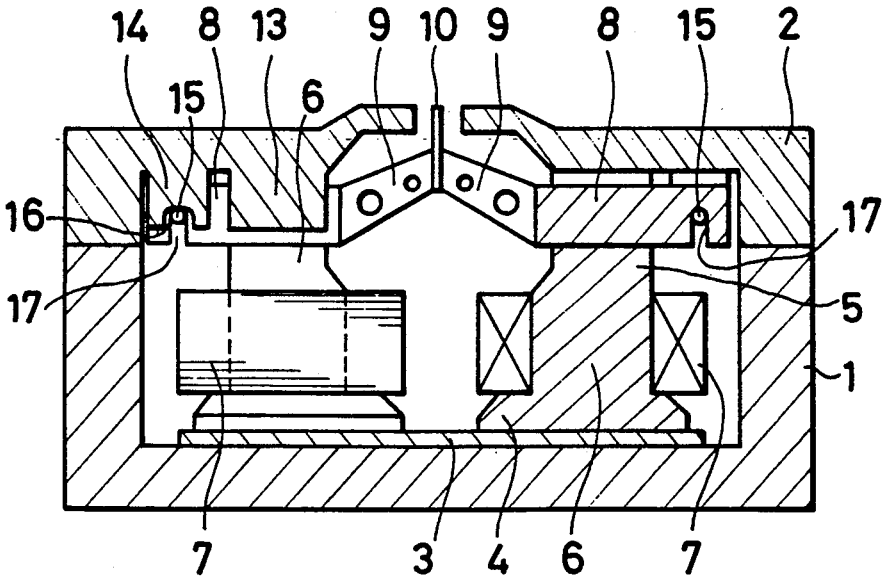
FIG. 1 is a vertical sectional view of the whole.

In the following, the first embodiment of the present invention is explained referring to FIG. 1 to FIG. 6. As shown in FIG. 1, an upper yoke 2 is joined to the opening port surface of a lower yoke 1 of a "U" shaped sectional form. A permanent magnet 3 is provided on a inner bottom surface of the lower yoke 1. Electromagnetic coils 7 are provided on individual cores 6 having protruded parts 5 in the upper parts and fixing parts 4 in the lower parts to be fixed to the permanent magnets 3. Armatures 8 facing the cores 6 have arms 9 of thin plates on their tips and on the tips of these arms there are fixed needles 10. Inside the upper yoke 2, protruding parts 13 and supporting parts 14, located on both sides of the armature 8, are formed into a body. The armature 8 and the supporting parts 14 are joined by a torsion bar 15 which is recognized as an elastic member.

Figure 2:
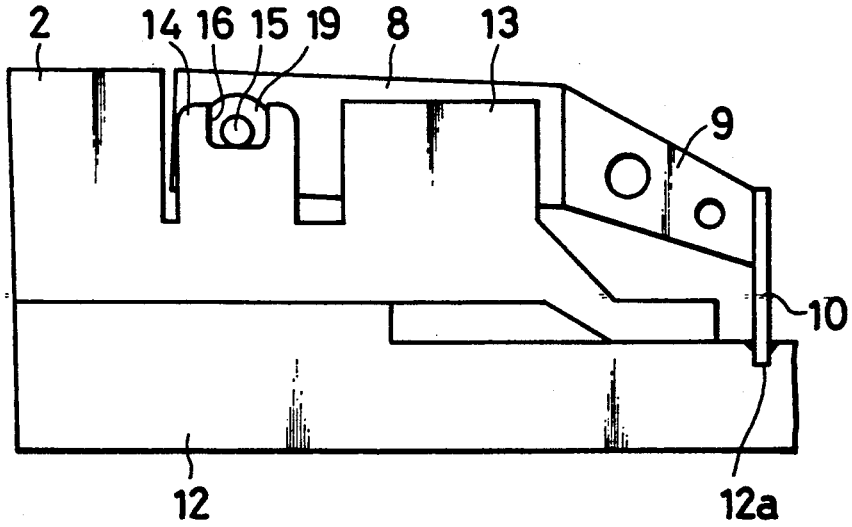
FIG. 2 is an enlarged side view of a state where a torsion bar is welded to supporting parts.
Figure 3:
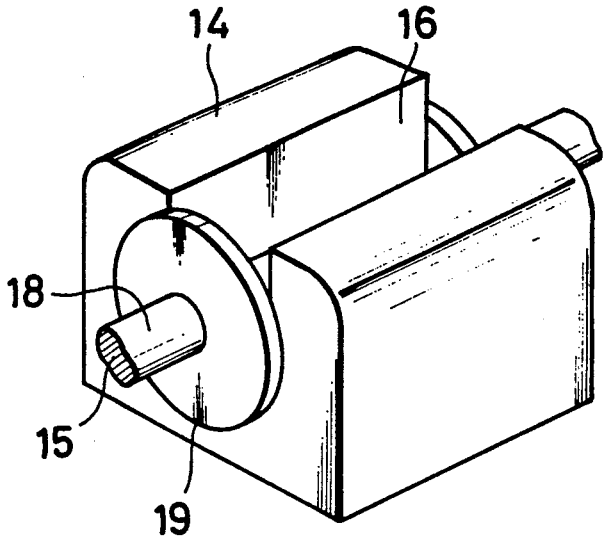
FIG. 3 is an enlarged perspective view of a fitting state of supporting parts and a torsion bar.

On the supporting parts 14 "U" shaped wide grooves 16 are formed into which the torsion bars 15 are inserted allowing play in a longitudinal direction of the armatures 8; on the armatures 8 grooves 17 are formed into which the torsion bars 15 are inserted with limited play in a longitudinal direction of the armatures 8. The central part of the torsion bar is inserted into the groove 17 on the armature 8 and they are welded to each other; then both ends of the torsion bar 15 are inserted into the wide grooves 16 of the supporting parts 14 and the upper yoke 2 is placed on a jig 12 as shown in FIG. 2 and the needle tip 10 is supported on the bottom surface of a groove 12*a* formed on the jig 12; in this state, both ends of the torsion bar 15 are welded to the bottom of the wide grooves 16 on the supporting parts 14. The bottom surface of the groove 12*a* on the jig 12 coincides with an outer peripheral surface of a platen assuming that a dot printer head is actually mounted on a printer. The both ends of the torsion bar 15 are welded to the supporting parts 14 in a state of operation where the armature 8 is detached from the core 6, but in a final assembly state, the armature 8 is attached to the core 6 attracted by the magnetic force of the permanent magnet 3; therefore an elastic part 18 is elastically twisted and shows resistance but the magnetic force of the permanent magnet 3 is stronger than the resisting force.

The soldering temperature of the torsion bar 15 is 700° C. The torsion bar 15 can be degraded by the temperature in welding, so that a united body in which the torsion bar is integrated with the upper yoke 2 and the armature 8 is put in a furnace to heat-treat for 3 hours at 500° C. (heat treatment in a marageing process).

Figure 6:
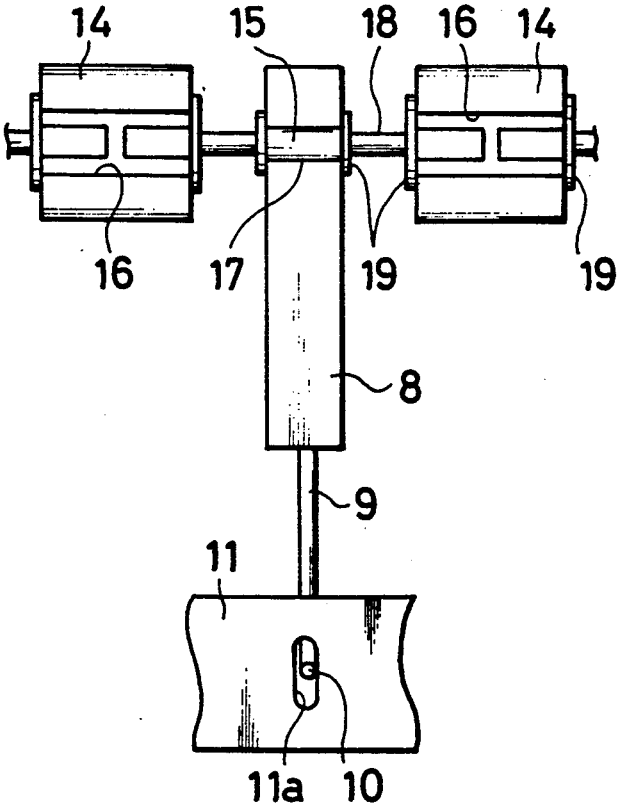
FIG. 6 is a plan view partially enlarged showing a joined state of supporting parts, an armature and a torsion bar.

In the torsion bar 15, as shown in FIG. 6, thin elastic parts 18 located on both sides of the armature 8 and flanges 19 located between the end parts of the elastic parts 18 and the end parts of the grooves 16 and 17 are formed into a unity.

Figure 4:
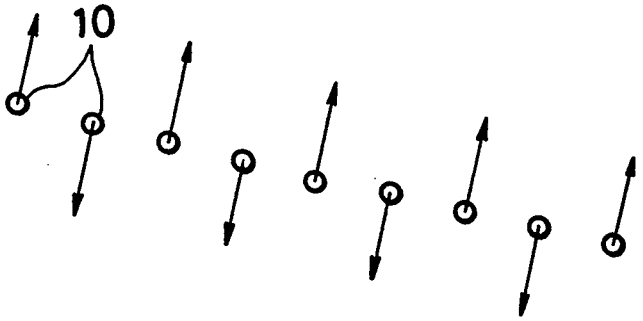
FIG. 4 is a drawing for explanation showing a state of disposition of needles and armatures.
Figure 5:
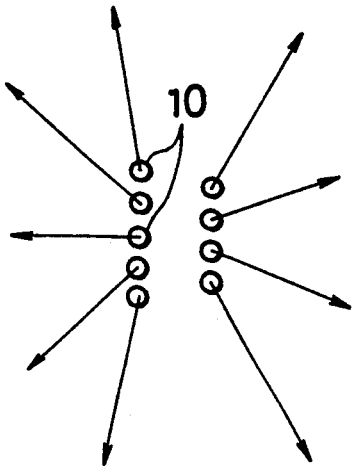
FIG. 5 is a drawing for explanation showing a state of disposition of needles and armatures.

FIG. 4 and FIG. 5 show a state of disposition of needles 10 and armatures 8 and in the drawings arrow marks show the direction in a longitudinal direction of armatures. FIG. 4 shows an example in which needles 10 are disposed in a line inclining to a horizontal line and armatures 8 are disposed in zigzag in two lines along the direction of a disposition line of the needles 10. FIG. 5 shows an example in which needles 10 are disposed in zigzag in two columns and the armatures are disposed in a ring shape. In both cases needles 10 are fixed to make an almost right angle to the longitudinal direction of armatures; such disposition is intended to avoid mutual interference between adjacent armatures 8.

In a constitution as mentioned in the above, when an electromagnetic coil 7 is energized, magnetic flux to cancel the magnetic force of the permanent magnet 3 is generated and an armature 8 is detached from an end face of the core 6 by the restoring force of the elastic part 18 of the torsion bar 15 and a needle 10 is protruded to perform printing; when electricity being supplied to the electromagnetic coil 7 is cut off the armature 8 is restored to the former position by the magnetic force of the permanent magnet 3. In this case, the elastic part 18 of the torsion bar 15 is elastically bent in a twisting direction.

As the core 6 is fixed on the permanent magnet 3, a magnetic path formed between the permanent magnet 3 and the armature 8 is shortened. In the case where the cores 6 disposed in two lines alternately as shown in FIG. 4, the intervals between adjacent lines are decided to be a definite value and the leakage flux and the magnetic interference between cores 6 are prevented. The contact area between the permanent magnet 3 and the fixing part 4 is made larger than the sectional area of the protruding part 5, so that the magnetic force of the permanent magnet 3 can be effectively utilized and the attracting force of the armature 8 can be improved by upgrading the flux density in the protruding part 5. Owing to the prevention of the magnetic flux leakage and magnetic interference between adjacent cores 6 an optional electromagnetic coil 7 can be energized at an optional timing; therefore dot pitch in the direction of a platen shaft can be arbitrarily set.

Soldering material is inserted utilizing the grooves 16 and 17 which the torsion bar 15 is fitted in and so places to be machined are decreased. By joining the flange 19 to the end parts of grooves 16 and 17, the positioning of the torsion bar 15 in the direction of its axis is facilitated and the flange 19 prevents the solder to flow to the elastic part 18, which prevents the characteristics of the elastic part 18 from change and also increases the contact area of soldering material to reinforce the soldered part.

As described in the above, when the armature 8 and the supporting parts 14 are joined with the torsion bar, owing to the play between the wide groove 16 and the torsion bar 15, the armature can be moved in the direction of its axis. It is therefore made possible to align the tip positions of needles and to solder the supporting parts 14, the armature 8 and the torsion bar 15 with the tip positions of needles 10 as standards. In the welding time, by moving the armature 8 there remains no strain in the armature 8 including the arm 9 and in the needle 10, so that the tip positions of needles 10 can be kept strictly accurate even when the upper yoke 2 is taken off from the jig 12. In this way, cost cutting is made possible in omitting needle guides; the total length of a needle 10 can be shortened without being affected by the stress from the needle guide; a needle can be made not to be bent easily, which makes the positioning of needle tips more accurate; a needle can be made lighter, which makes high speed printing easier.

Recently, there is a demand for high speed printing with high density dots, and to accede such a demand a dot printer head with 32 thin needles of 0.2 mm is found in the market, but there is the possibility that a needle pierces the ribbon and cannot return to its initial position. In such a case, if there is a needle guide, the needle can be detached from the ribbon easily. Under these circumstances, if there is a request to equip a needle guide on the upper yoke 2, considering that the armature 8 rotates with the torsion bar 15 as a supporting axis as shown in FIG. 6, a needle guide 11 is used in which a long-shaped hole along the longitudinal direction of the armature 8 is formed. The friction between the needle 10 and the long-shaped hole 11*a* can be prevented in this arrangement. This needle guide 11 is an example in which dimensional tolerance is scaled up.

A narrow groove 17 can be formed on the armature 8 and a wide groove 16 on the supporting part 14. In this case, at first both ends of the torsion bar 15 are inserted into the grooves 16 on the supporting parts 14 and are welded to the grooves and then the tip of the needle 10 is positioned by using the jig 12 and the central part of the torsion bar 15 is inserted into the wide groove 17 on the armature 8 and it is welded to the groove.

Figure 7:
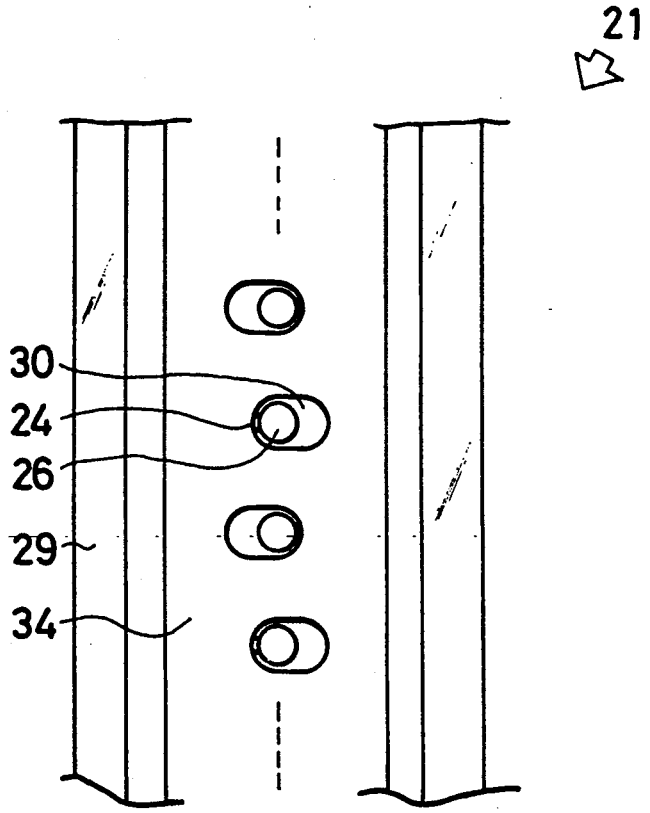
FIG. 7 is a plan view showing a second embodiment of the present invention.
Figure 8:
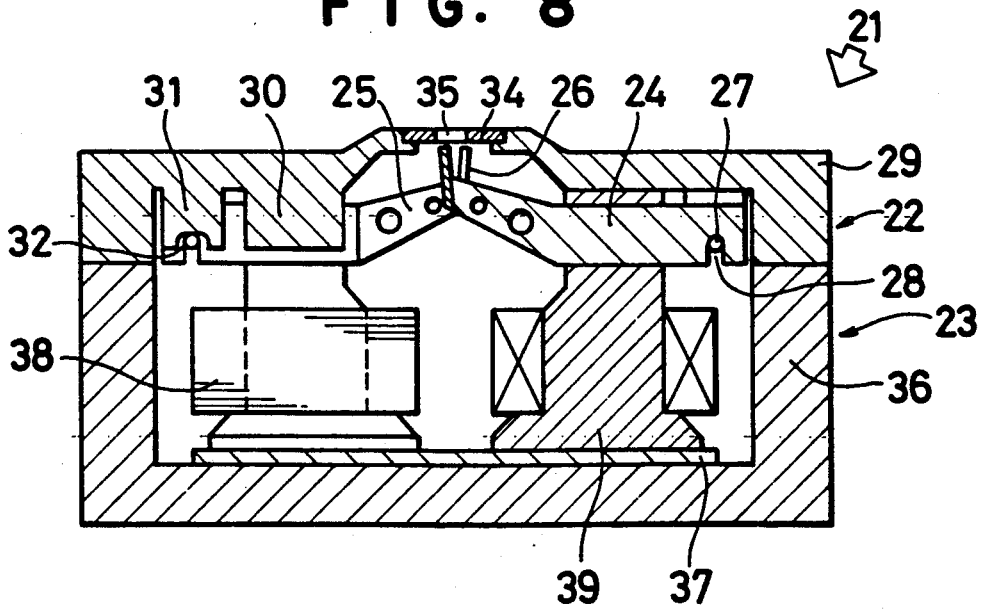
FIG. 8 is a vertical sectional view of what is shown in FIG. 7.
Figure 9:
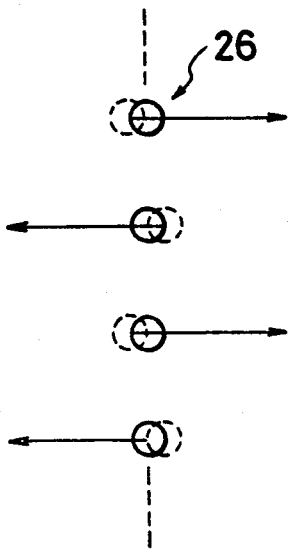
FIG. 9 is a drawing for explanation of a locus drawn by a needle tip.

In the following a second embodiment is explained referring to FIG. 7 to FIG. 11. The releasing type dot printer head of this type 21 comprises an armature block 22 and a magnet block 23. At first explanation is given on the armature block 22. The part from the middle to the end of the armature 24 is formed to a thin plate having an upwardly extending slant, and this forms an arm part 25 with lightening holes. A short, rigid needle 26 is provided on the tip of the armature 24 and on the base end part of the armature 24 a groove 28 is provided in which a torsion bar 27 is to be fixed. On a first yoke 29 a protruded part 30 in the form of a partition plate and a supporting part 31 in the form of a square pillar are provided downward. On the head part of the supporting part 31 a "U"-shaped groove 32 which is long in the longitudinal direction of the armature 24 is provided; to the groove 32 the armature 24 is to be fixed. The torsion bar 27, which is to be fitted into the "U"-shaped groove 32 with play, is provided with a flange part 33 virtually covering the "U"-shaped groove 32. A flat needle cover 34 is fixed on the crown part, protruding a little bit, in the central part of the first yoke 29. On the needle cover 34, for example, as shown in FIG. 7 inserting holes with play 35 which are long in the longitudinal direction of the armature 24 and have wider openings than the diameter of the needle 26 are disposed consecutively in a staggered state in the longitudinal direction of the armature 24. The disposition of inserting holes, as shown in FIG. 9 coincides with the locus drawn by the tips of the needles 26 in printing operation. In other words these inserting holes with play 35 are so formed that when the releasing type dot printer head 21 performs printing operation the needles 26 do not abut the peripheries of the holes 35.

The constitution of a magnet block 23 is explained in the following. On a magnet 37, a magnetic member in the form of a thin plate laid on the bottom part of a box-like second yoke 36, a pillar-like core 39 wound with an electromagnetic coil 38 is provided facing the armature 24. Under normal condition, the core 39 is magnetized by the magnetic force of the magnet 37 and generates magnetic force which is opposite to the magnetic force generated by the electromagnetic coil 38.

In a constitution as described in the above, the releasing type dot printer head 21 of this type performs printing operation in the similar way to a releasing type dot printer head of conventional type.

Figure 10:
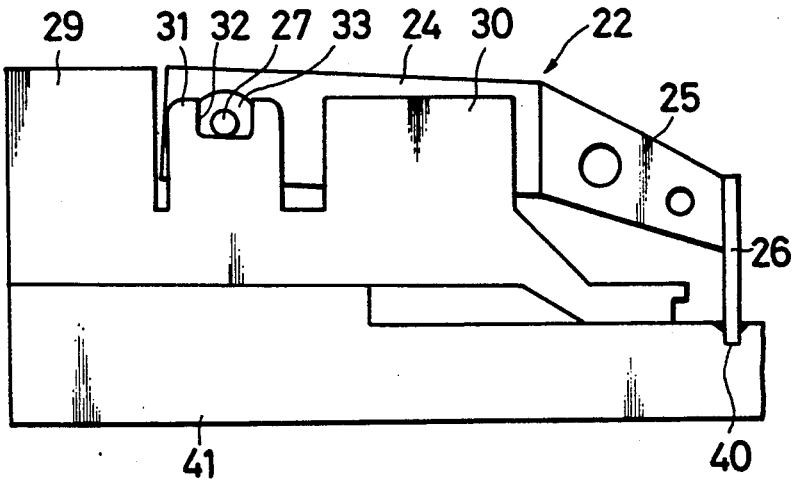
FIG. 10 is a drawing for explanation when an armature is to be fixed on a first yoke.
Figure 11:
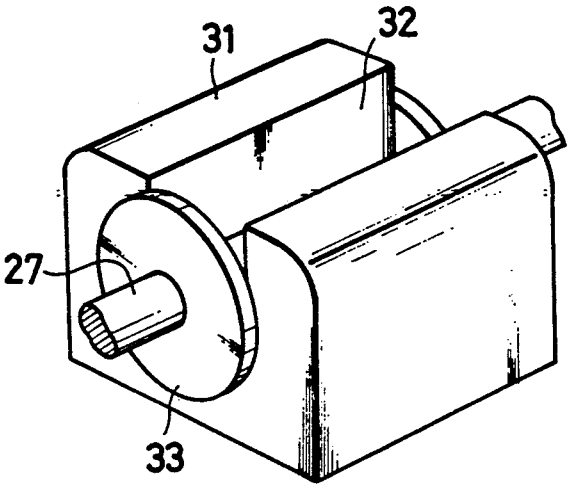
FIG. 11 is perspective view of an important part.

Following is the explanation on the actual manufacture of the armature block of a releasing type dot printer head of this type referring to FIG. 10. At first, the first yoke 29 is fixed to a jig 41 on which a groove 40 is cut into which each needle 26 is to be fitted in; then a torsion bar 27 is fitted into the groove 28 on the armature 24 and fixed to the groove; the armature 4 is placed between the supporting part 31 and the protruding part 30 and its needle 26 is fitted into the groove 40 on the jig 41. At this time the tips of needles are aligned in the optimum positions for printing and the torsion bars 27 are fitted with play in the "U"-shaped grooves 32 in a state where their positions are adjustable. Under these conditions, for example, torsion bars 27 are fixed to the supporting parts 31 with a filler such as solder (not shown in the drawing); thereby the releasing type dot printer head 21 is constituted so that the tip of each needle can be situated at the optimum position in printing.

Figure 12:
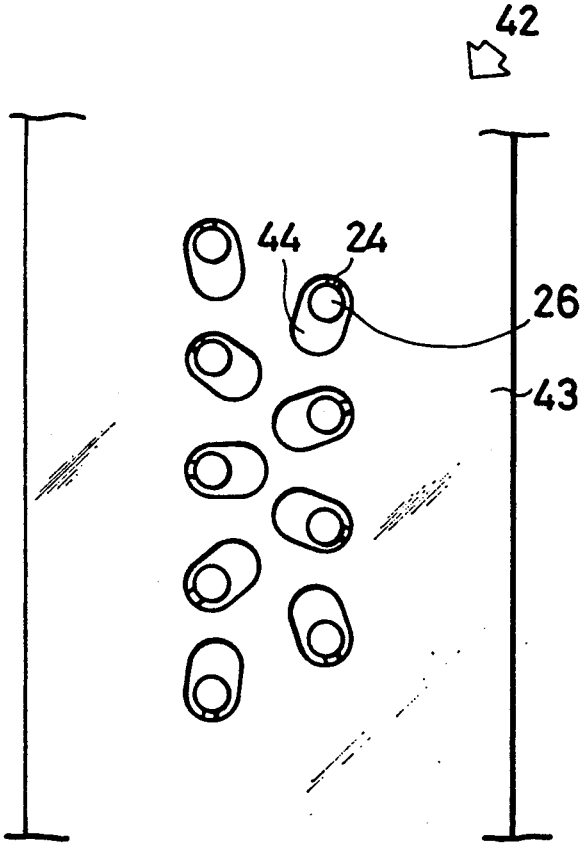
FIG. 12 is a plan view showing a third embodiment of the present invention.
Figure 13:
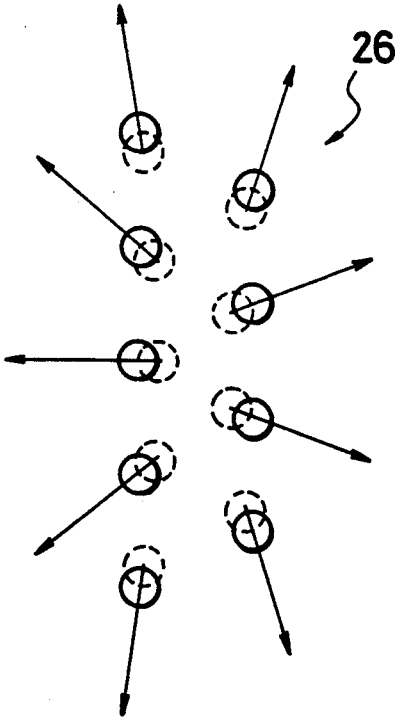
FIG. 13 is a drawing for explanation of a locus drawn by a needle tip.

Following is the explanation of a third embodiment referring to FIG. 12 and FIG. 13. For the same portions as those in the second embodiment the same names and the same symbols are used and the explanations on them are also omitted. In a releasing type dot printer head of this type 42, armatures 24 are disposed in a circular arc form on a yoke (not shown in the drawing) and needles are disposed in two lines. Inserting holes with play 44 formed on a needle cover 43 are disposed radially in two lines. The pattern of inserting holes 44, for example as shown in FIG. 13, coincides with the locus drawn by the tips of needles 26 when printing operation is performed. In other words, the inserting holes 44 are so constituted that when the releasing type dot printer head of this type 42 performs printing operation the needles 26 do not abut the peripheries of the inserting holes 44.

As described in the above, in the releasing type dot printer head of this type 42, armatures 24 are disposed in the form of a circular arc, so that a main body of heads (not shown in the drawing) is expected to be smaller and furthermore needles 26 are disposed in two lines, so that the intervals between needles are equivalently reduced by utilizing time sharing operation etc. to make high density printing possible.

In the releasing type dot printer heads of type 21 and 42 shown in the second and third embodiments, needles 26 are not supported by needle covers 34 and 43 but they support for themselves. It might be considered that even though needle covers 34 and 43 are not provided a device can be constituted to be able to print, but in the actual printing in recent times fine needles 26 are used, so that it can occur that a needle pierces a ink ribbon. In this case, if the needle covers 34 and 43 are not provided, a needle returning to the head may pull the ribbon into the releasing type dot printer head of type 21 and 42, which may cause needle breakage or ink ribbon breakage. If the needle covers 34 and 43 are provided, even if a needle 26 pierces a ink ribbon when the needle returns the ink ribbon abuts a needle cover 34 or 43 and the needle is pulled off. In this way, printing can be executed free from care of needle breakage etc., and the needles can be made finer; thereby the development of a device which performs higher density printing can be expected.

Figure 14:
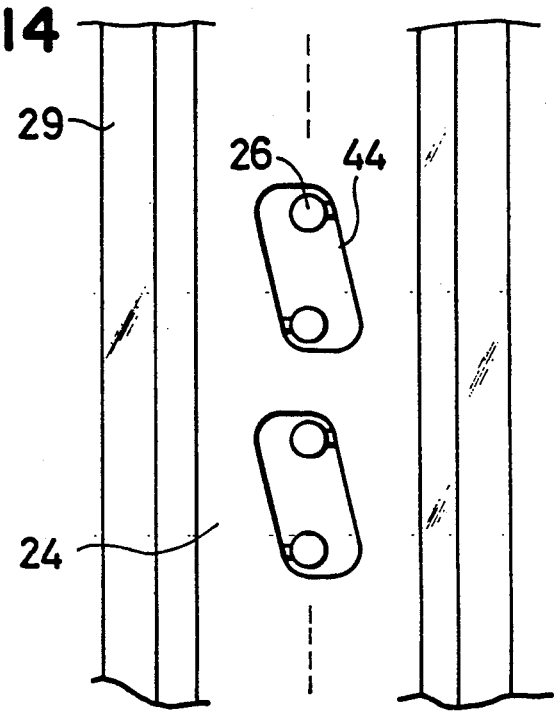
FIG. 14 is a plan view showing a fourth embodiment of the present invention.

In FIG. 14 the fourth embodiment of the present invention is shown in which an opening 44 is formed for the insertion of two needles 26 disposed in line.

Figure 15:
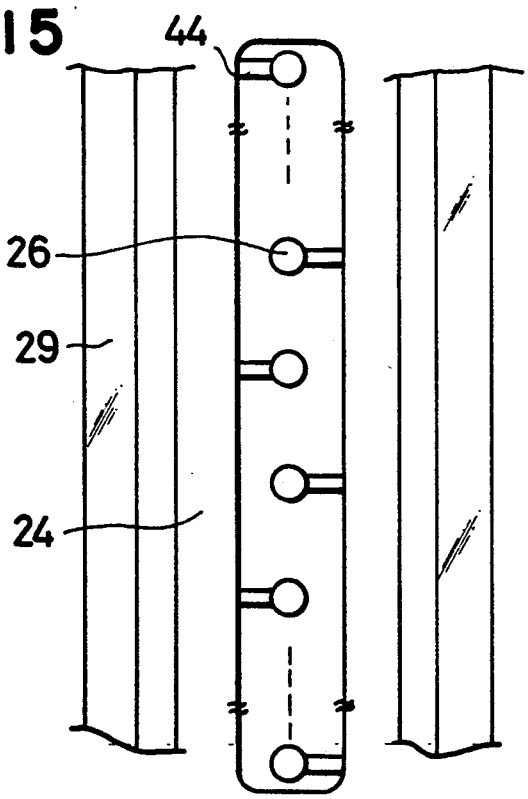
FIG. 15 is a plan view showing a fifth embodiment of the present invention.

In FIG. 15 the fifth embodiment of the present invention is shown in which a long and narrow hole 44 is formed for the insertion of all needles 26 disposed in line. The movement of an ink ribbon is limited with the periphery of the opening 44.

Figure 16:
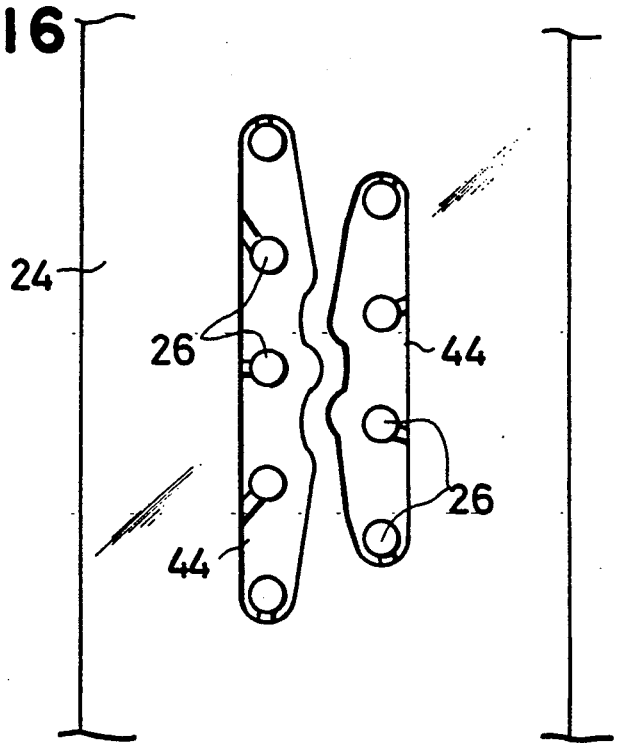
FIG. 16 is a plan view showing a sixth embodiment of the present invention.

In FIG. 16 the sixth embodiment of the present invention is shown in which openings 44 are formed for respective lines of needles disposed in two lines.

Figure 17:
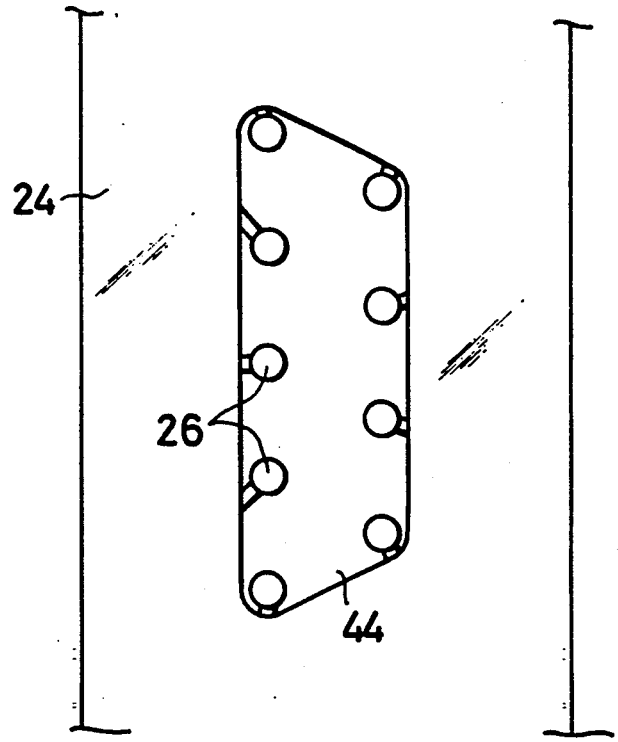
FIG. 17 is a plan view showing a seventh embodiment of the present invention.
Figure 18:
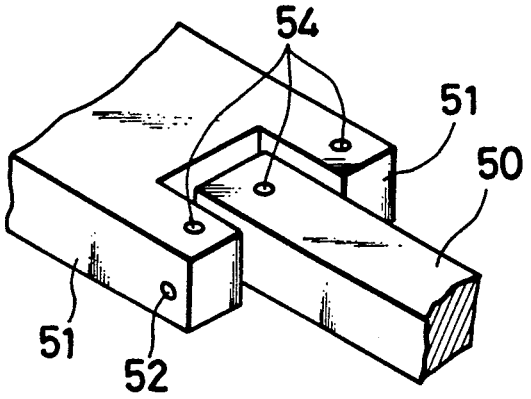
FIG. 18 (PRIOR ART)
FIG. 18 is a partial perspective view showing a joined state of supporting parts, an armature and a torsion bar of a conventional type.
Figure 19:
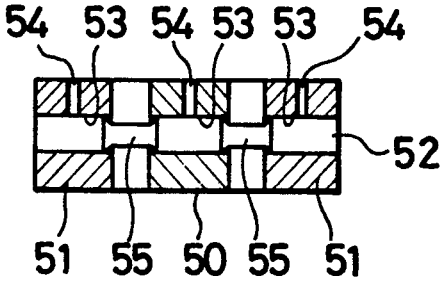
FIG. 19 (PRIOR ART)
FIG. 19 is a sectional view of what is shown in FIG. 18.

In FIG. 17 the seventh embodiment of the present invention is shown in which an opening 44 is formed for the insertion of all needles 26 disposed in two lines. The periphery of the opening 44 is positioned close to all the needles 26.

What is claimed is:

1. A releasing type dot print head comprising:

a plurality of cores which are fitted with electromagnetic coils;

a plurality of armatures having needles on one of their end parts, said needles comprising needle tips which define needle tip positions, said armatures being opposingly disposed with respect to said cores;

supporting parts disposed on both sides of the other end part of each of said armatures; and elastic-member holding parts having openings for holding elastic members with limited play in the longitudinal direction of said armature when said elastic member is inserted into said openings said elastic-member holding parts being formed on said armatures and said supporting parts;

wherein at least one of said openings of said elastic-member holding parts formed on said armatures and said supporting parts is wider than the other openings of said elastic-member hodling parts for allowing additional play in the longitudinal direction of said armature, and wherein the play in the longitudinal direction of said armature allowed by said openings enable said needle tip positions to be disposed in fixed positions such that said needle tip positions act as standards when said elastic members are welded to said elastic-member holding parts.

2. A releasing type dot printer head according to claim 1 wherein the elastic member is formed with a torsion bar.

3. A releasing type dot printer head according to claim 1 wherein the elastic-member-holding part is formed with a groove.

4. A releasing type dot printer head according to claim 1 wherein the elastic-member-holding part is formed with a hole.

5. A releasing type dot printer head according to claim 1 wherein the wide opening is formed with a wide groove.

6. A releasing type dot printer head according to claim 1 wherein the wide opening is formed with a wide hole.

7. A releasing type dot print head comprising:

a plurality of armatures having needles at one of their end parts, said needles being energized in a direction toward a printing paper by elastic members which are provided on the other end parts of said armatures, wherein said needles comprise needle tips and are short needles;

magnetic members for magnetically attracting said armature;

electromagnetic coils for generating a magnetic force opposite to the magnetic attracting force of said magnetic members; and a needle cover having a surface facing said paper, said needle cover being positioned at said needle tips and within a moving range of said needle tips, said needle cover comprising openings which are wider than the diameter of the needles, the wideness of said openings being such that, during printing, the needles do not abut against the peripheries of the openings in the needle covers.

8. A releasing type dot print head comprising:

a plurality of armatures having needles at one of their end parts, said needles being energized in a direction toward a printing paper by elastic members which are provided on the other end parts of said armatures, wherein said needles comprise needle tips and are short needles;

magnetic members for magnetically attracting said armatures;

electromagnetic coils for generating a magnetic force opposite to the magnetic attracting force of said magnetic members; and a needle cover having a surface facing said paper, said needle cover being positioned at said needle tips and within a moving range of said needle tips, said needle cover comprising openings which are wider than the diameter of the needles and extend in the longitudinal direction of said armatures, wherein said openings allow play of said needles in the longitudinal direction of said armatures and said needles do not abut against the peripheries of the openings during printing.

* * * * *